US005463800A

United States Patent [19]

Rojdev

[11] Patent Number: 5,463,800

[45] Date of Patent: Nov. 7, 1995

[54] SEAL SUSTAINING HARDWARE FOR CASKETS

[75] Inventor: Ilija Rojdev, Cincinnati, Ohio

[73] Assignee: Batesville Casket Company, Inc., Batesville, Ind.

[21] Appl. No.: 212,268

[22] Filed: Mar. 14, 1994

[51] Int. Cl.[6] ..... A61G 17/00

[52] U.S. Cl. ..... 27/1; 27/27; 16/112

[58] Field of Search ..... 27/1, 2, 27, 35; 16/110 R, 111 R, 112; 411/546, 542, 544, 369, 370

[56] References Cited

U.S. PATENT DOCUMENTS

| | | | |
|---|---|---|---|
| 3,191,730 | 6/1965 | Fischer | 411/542 |
| 3,204,286 | 9/1965 | Hillenbrand . | |
| 4,077,096 | 3/1978 | Christian . | |
| 4,102,030 | 7/1978 | King, Jr. | 411/542 X |
| 4,615,085 | 10/1986 | Hartman . | |
| 5,144,727 | 9/1992 | Craft . | |
| 5,309,614 | 5/1994 | MacKirby | 27/1 X |

FOREIGN PATENT DOCUMENTS

| | | | |
|---|---|---|---|
| 391668 | 5/1933 | United Kingdom | 411/542 |

*Primary Examiner*—Carl D. Friedman
*Assistant Examiner*—Kien T. Nguyen
*Attorney, Agent, or Firm*—Wood, Herron & Evans

[57] ABSTRACT

Casket hardware comprises a corrosive trim plate adapted to be secured to an outer surface of a wall or a casket, an arm adapted to support a casket handlebar and having a bolt connected thereto, the bolt being adapted to pass through the plate and the casket wall, a nut threadably engaging the bolt interior of the casket, a seal surrounding the bolt between the nut and the inner surface of the casket wall and a non-corrosive compressive load carrying member between the casket wall and the arm for creating tension in the bolt as the nut is tightened against the seal. When the corrosive trim plate corrodes and falls away from between the casket wall and the arm the non-corrosive compressive load carrying member maintains the bolt in tension thereby maintaining the seal in compression between the nut and the casket wall inner surface.

16 Claims, 1 Drawing Sheet

SEAL SUSTAINING HARDWARE FOR CASKETS

FIELD OF THE INVENTION

This invention relates generally to caskets, and more particularly to hardware for use on metal caskets which sustains or maintains an effective seal about the casket wall through holes should the decorative plate which the hardware mounts to the casket shell corrode and dissipate.

BACKGROUND OF THE INVENTION

A casket is formed as a deep, hollow metal shell which is closed by a cap or top. Much effort is expended to provide assurance that the casket is leak-tight so that water cannot leak into the casket when the casket is buried underground. It is also important that body gases or liquids not leak out of the casket when disposed in a mausoleum, etc. Special gaskets have been designed for engagement of the cap with the shell to prevent leakage around the perimeter of the casket. One of the final steps in the manufacturing process of the casket is to pressure test the casket with the lid closed to determine whether the casket, before it is shipped, is indeed leak tight.

The casket hardware presents a potential site for leakage. Conventionally, holes are drilled through the walls of the casket shell. Bolts are passed through these through holes to mount hardware to the shell, the hardware providing the handles by which the casket is carried. Washers are inserted over the bolts interior of the casket, and a nut is threaded onto the bolt for securing the washer thereon. Sealing mastic is disposed about the bolt between the washer and the inner surface of the casket wall. Tightening the nut on the bolt causes the bolt to compress the trim hardware, sometimes known as "ear" hardware or an "escutcheon" plate, thereby creating tension in the bolt, which causes the nut and washer to compress the sealing mastic to the inner surface of the casket wall, thus sealing the hole.

The problem associated with this traditional mounting of hardware to the casket wall and sealing thereof is that when the ear hardware or escutcheon plate, commonly fabricated of zinc, corrodes, dissipates and otherwise falls away from between the casket wall and the bolt head, the means for creating tension in the bolt and hence compression in the sealing mastic between the washer and the casket wall inner surface is eliminated. Thus, without bolt tension to compress the sealing mastic between the washer and the casket wall inner surface, the seal is effectively compromised or lost.

BRIEF DESCRIPTION OF THE INVENTION

It has therefore been an objective of the present invention to provide hardware for caskets which sustains or otherwise maintains an effective seal about the through holes in the casket walls should the trim plates corrode and fall away from the bolts in the casket wall.

The objective of the present invention has been attained by providing casket hardware which comprises a corrosive trim plate adapted to be secured to an outer surface of the wall of the casket, an arm adapted to support a casket handlebar, the arm having a bolt connected thereto, the bolt being adapted to pass through the plate and the casket wall, a nut threadably engaging the bolt interior of the casket, a seal surrounding the bolt between the nut and an inner surface of the casket wall, and a non-corrosive compressive load carrying member between the casket wall and the arm for creating tension in the bolt as the nut is tightened against the seal. When the corrosive trim plate corrodes and falls away from between the arm and the casket wall the non-corrosive compressive load carrying member maintains the bolt in tension thereby maintaining the seal in compression between the nut and the casket wall inner surface thereby sustaining the integrity of the seal.

The arm includes a clevis, with the bolt being secured to the clevis. The non-corrosive compressive load carrying member includes a cylinder having first and second ends. The bolt passes through the cylinder, with the cylinder first end abutting the clevis, and the cylinder second end abutting the casket wall outer surface. The cylinder has a inner diameter sized so as to create a press fit of the cylinder onto the bolt. The cylinder has a flange on the second end, with the flange abutting the casket wall outer surface. The non-corrosive compressive load carrying member is preferably fabricated from plastic.

The trim plate includes a fastener securement surface and a casket wall facing surface. The fastener securement surface is that surface which is contacted by the arm clevis when the bolt is inserted through the plate. The casket wall facing surface is the extrememost surface of the plate facing the casket wall. To ensure that the non-corrosive compressive load carrying member or spacer, and not the trim plate, carries the compressive load as the nut is tightened on the bolt, the spacer has a length dimension greater than the distance between the plate fastener securement and casket wall facing surfaces.

An advantage of the present invention is that in casket hardware, when the decorative trim plate, or ear hardware or escutcheon plate, corrodes and falls away from the hardware bolt, the seal sealing the casket wall through hole remains intact and is not compromised thereby.

These and other objects and advantages of the present invention will become more readily apparent during the following detailed description taken in conjunction with the drawings herein in which:

DETAILED DESCRIPTION OF THE INVENTION

Figure 1:
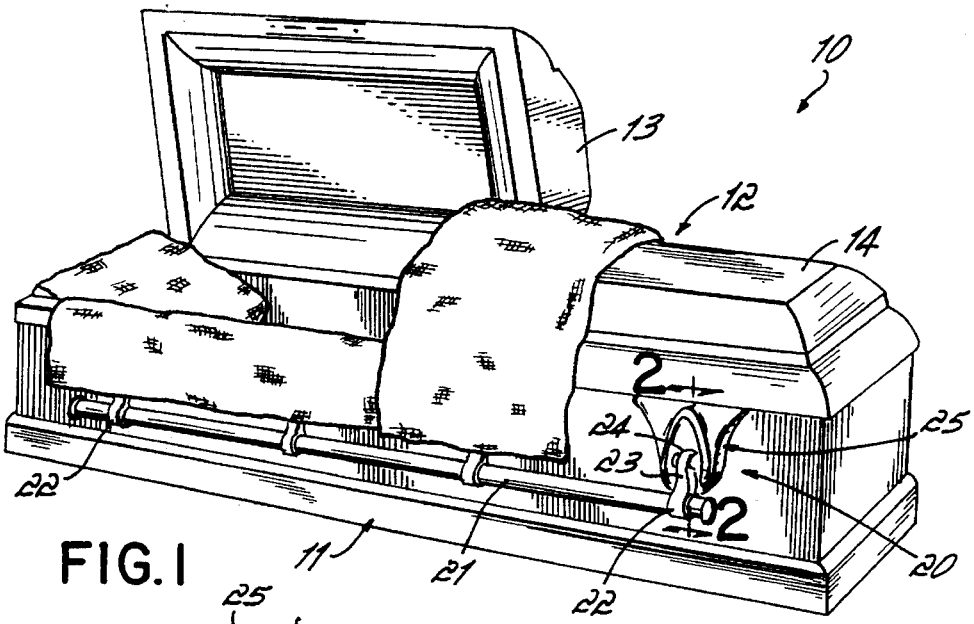
FIG. 1 is a perspective view of a casket showing its hardware mounted on the shell.

Referring first to FIG. 1, there is shown a casket 10 having a sheet metal shell 11 enclosed by cap 12. The cap 12 has a head section 13 and foot section 14. Seals or gaskets (not shown) around the perimeter of the head section and foot section 12 and 13, respectively, are provided to form a leak-tight joint between the cap and seal.

The hardware indicated at 20 can take many forms. The illustrated hardware is merely exemplary. A handle bar 21 is mounted, at a number of places along its length, to the free end 22 of an arm 23. The arm 23 is pivoted at 24 to a wall of the shell 11, and a die-cast trim plate, otherwise known as an "ear" or "escutcheon" 25, overlies the joint between the arm 23 and the shell 11.

Figure 2:
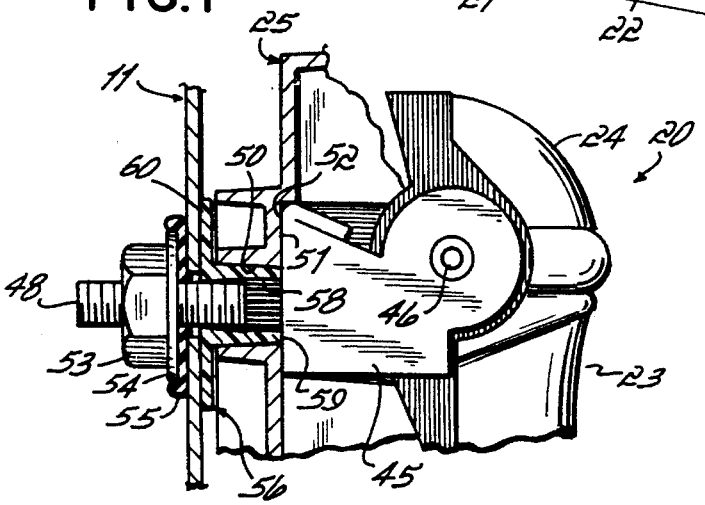
FIG. 2 is an assembled side cross-sectional view taken along one 2—2 of FIG. 1 illustrating the mounting hardware of the present invention.
Figure 3:
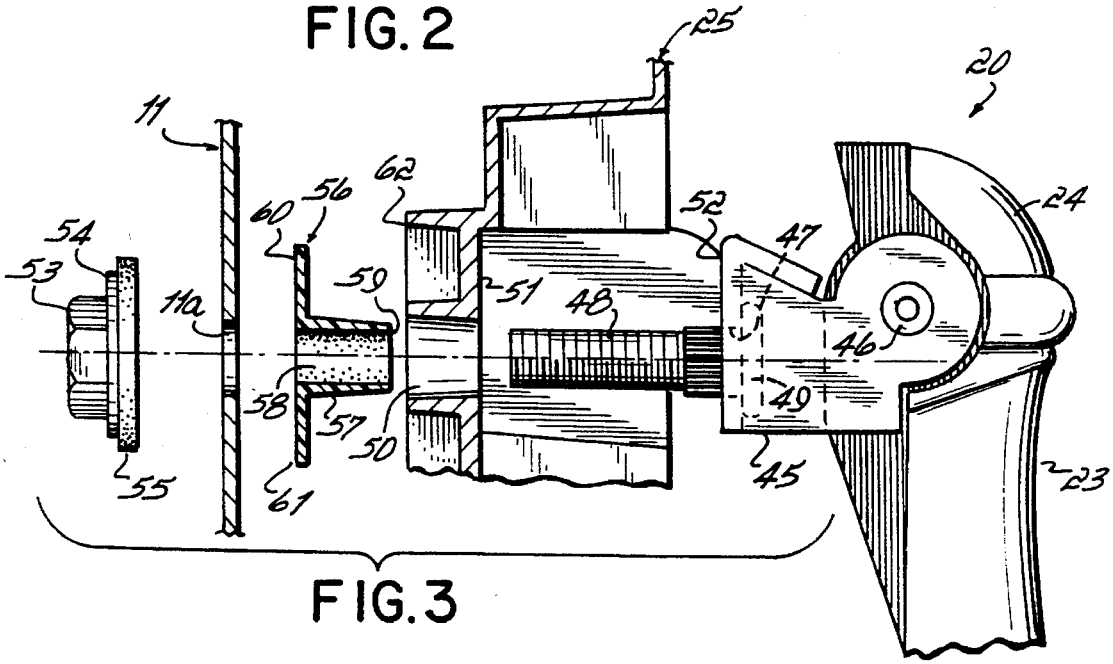
FIG. 3 is a view similar to FIG. 2 except with the hardware shown exploded in disassembled form.

FIGS. 2–3 shown the details of the mounting of a representative arm 23. The arm 23 has a clevis 45 mounted to it by a rivet 46. The clevis has a mounting hole 47. A bolt 48 having a head 49 on one end is press fitted into the hole 47 in the clevis 45. Escutcheon 25 has a through hole 50 therethrough for accepting the shank of bolt 48. The wall of casket shell 11 has a through hole 11a for accepting the shank of bolt 48. Escutcheon 25 has a surface 51 which faces the arm 23 and against which is abutted a forward face 52 of clevis 45 when bolt 48 is inserted through hole 50. For securing bolt 48 on the interior of the casket there is a nut 53 which threadably engages the bolt 48, and a washer 54 is disposed between nut 53 and the casket wall. Sealing mastic 55 surrounds the bolt 48 and is disposed between the washer 54 and the inner side or surface of the wall of shell 11.

A non-corrosive, for example plastic, spacer 56 is disposed between the casket shell 11 and the arm 23. The spacer 56 preferably includes a cylindrical portion 57 which fits in hole 50 of escutcheon 25 and which includes an inner bore or diameter 58 sized so as to be a press fit on the shank of bolt 48. One end 59 of the cylinder 57 abuts the casket wall facing face 52 of the clevis 45, while the other end 60 which includes a flange 61 thereon abuts the outer surface of the wall of casket shell 11. The spacer 56 is sized so as to be longer than the distance between the surface 51 of escutcheon plate 25 and a casket wall facing surface 62 of escutcheon plate 25, such that when nut 53 is tightened onto bolt 48 spacer 56 carries the compressive load which generates tension in bolt 48 and hence compression in mastic seal 55 between washer 54 and the wall of shell 11. Thus, reliance is not made on escutcheon plate 25 as being the means to generate the tension in bolt 48 upon tightening of nut 53. Thus, when escutcheon 25 corrodes, dissipates and otherwise falls away from between the casket shell 11 and the arm 23, the compressive load carrying member, the non-corrosive spacer 56, remains in place thus ensuring that bolt 48 remains in tension and that mastic seal 55 remains in compression between seal 54 and shell 11 thus insuring the integrity of the seal.

Another advantageous feature of spacer 56 is that it provides a handy means of forming a subassembly of escutcheon 25, arm 23 and bolt 48, since spacer 56, press fitted onto the shank of bolt 48 after bolt 48 is inserted through hole 50 of escutcheon 25, readily holds the various components together as a single unit. Thus, spacer 56 serves to speed the manufacturing process by allowing an assembler to handle a subassembly rather than many individual pieces.

Those skilled in the art will readily recognize numerous adaptations and modifications which can be made to the casket hardware of the present invention and which result in improved casket hardware, yet all of which will fall within the spirit and scope of the present invention as defined by the following claims. Accordingly, the invention is to be limited only by the scope of the following claims and their equivalents.

What is claimed is:

1. Casket hardware in combination with a casket, said casket having an interior and a wall having inner and outer surfaces, said combination comprising:

a corrosive trim plate;

an arm adapted to support a casket handle bar, said arm having a bolt connected thereto, said bolt passing through said plate and said casket wall;

a nut threadably engaging said bolt within said interior of said casket;

a seal surrounding said bolt between said nut and said inner surface of said casket wall; and a noncorrosive compressive load carrying member disposed between and contacting said casket wall and said arm for creating tension in said bolt as said nut is tightened against said seal;

said noncorrosive compressive load carrying member maintaining said bolt in tension thereby maintaining said seal in compression between said nut and said casket wall inner surface when said corrosive trim plate corrodes and falls away from between said arm and said casket wall.

2. The combination of claim 1 wherein:

said arm includes a clevis, said bolt being secured to said clevis, said noncorrosive compressive load carrying member includes a cylinder having first and second ends, said bolt passing through said cylinder, said cylinder first end abutting said clevis, said cylinder second end abutting said casket wall outer surface.

3. The combination of claim 2 wherein said cylinder has an inner diameter sized so as to create a press fit of said cylinder onto said bolt.

4. The combination of claim 3 wherein said cylinder has a flange on said second end, said flange abutting said casket wall outer surface.

5. The combination of claim 4 wherein said noncorrosive compressive load carrying member is fabricated from plastic.

6. Casket hardware in combination with a casket, said casket having an interior and a wall having inner and outer surfaces, said combination comprising:

A corrosive trim plate having a fastener securement surface and a casket wall facing surface;

an arm adapted to support a casket handle bar, said arm having a bolt connected thereto, said bolt passing through said plate and said casket wall;

a nut threadably engaging said bolt within said interior of said casket;

a seal surrounding said bolt between said nut and said inner surface of said casket wall; and a noncorrosive spacer having first and second ends disposed between said casket wall and said arm, said spacer first end abutting said arm and said spacer second end abutting said casket wall outer surface, said spacer having a length dimension greater than the distance between said plate fastener securement and casket wall facing surfaces;

said noncorrosive spacer maintaining said bolt in tension thereby maintaining said seal in compression between said nut and said casket wall inner surface when said corrosive trim plate corrodes and falls away from between said arm and said casket wall.

7. The combination of claim 6 wherein:

said arm includes a clevis, said bolt being secured to said clevis, said noncorrosive spacer includes a cylinder having first and second ends, said bolt passing through said cylinder, said cylinder first end abutting said clevis, said cylinder second end abutting said casket wall outer surface.

8. The combination of claim 7 wherein said cylinder has an inner diameter sized so as to create a press fit of said cylinder onto said bolt.

9. The combination of claim 8 wherein said cylinder has a flange on said second end, said flange abutting said casket wall outer surface.

10. The combination of claim 9 wherein said noncorrosive spacer is fabricated of plastic.

11. Casket hardware in combination with a casket, said casket having an interior and a wall having inner and outer surfaces, said combination comprising:

a trim plate;

a bolt having a load carrying surface on one end, said bolt passing through said plate and said casket wall;

a nut threadably engaging said bolt within said interior of said casket;

a seal surrounding said bolt between said nut and said inner surface of said casket wall; and a noncorrosive compressive load carrying member disposed between and contacting said casket wall and said bolt load carrying surface for creating tension in said bolt as said nut is tightened against said seal;

said noncorrosive compressive load carrying member maintaining said bolt in tension thereby maintaining said seal in compression between said nut and said casket wall inner surface should said trim plate corrode and fall away from between said bolt load carrying surface and said casket wall.

12. The combination of claim 11 wherein said noncorrosive compressive load carrying member is a plastic cylinder having a flange on its casket wall end and an inner diameter sized so as to create a press fit of said cylinder onto said bolt.

13. Casket hardware in combination with a casket, said casket having an interior and a wall having inner and outer surfaces, said combination comprising:

a trim plate having a fastener securement surface and a casket wall facing surface;

a bolt having a load carrying surface on one end engaged with said plate fastener securement surface, said bolt passing through said plate and said casket wall;

a nut threadably engaging said bolt within said interior of said casket;

a seal surrounding said bolt between said nut and said inner surface of said casket wall; and a noncorrosive spacer having first and second ends disposed between said casket wall and said bolt load carrying surface, said spacer first end abutting said bolt load carrying surface and said spacer second end abutting said casket wall outer surface, said spacer having a length dimension greater than the distance between said plate fastener securement and casket wall facing surfaces;

said noncorrosive spacer maintaining said bolt in tension thereby maintaining said seal in compression between said nut and said casket wall inner surface should said trim plate corrode and fall away from between said bolt load carrying surface and said casket wall.

14. The combination of claim 13 wherein said noncorrosive spacer is a plastic cylinder having a flange on said second end and an inner diameter sized so as to create a press fit of said cylinder onto said bolt.

15. Casket hardware in combination with a casket, said casket having an interior and a wall having inner and outer surfaces, said combination comprising:

a plate;

an elongated first portion of a fastener assembly having a load carrying surface on one end, said elongated first portion passing through said plate and said casket wall;

a second portion of said fastener assembly for securing said first portion within said interior of said casket;

a seal surrounding said fastener assembly first portion between said fastener assembly second portion and said inner surface of said casket wall; and a noncorrosive compressive load carrying member disposed between and contacting said casket wall and said fastener assembly first portion load carrying surface for creating tension in said fastener assembly first portion as said fastener assembly second portion is tightened against said seal;

said noncorrosive compressive load carrying member maintaining said fastener assembly first portion in tension thereby maintaining said seal in compression between said fastener assembly second portion and said casket wall inner surface should said plate corrode and fall away from between said fastener assembly first portion load carrying surface and said casket wall.

16. Casket hardware in combination with a casket, said casket having an interior and a wall having inner and outer surfaces, said combination comprising:

a plate having a fastener securement surface and a casket wall facing surface;

an elongated first portion of a fastener assembly having a load carrying surface on one end engaged with said plate securement surface, said elongated portion passing through said plate and said casket wall;

a second portion of said fastener assembly for securing said first portion within said interior of said casket;

a seal surrounding said fastener assembly first portion between said fastener assembly second portion and said inner surface of said casket wall; and a noncorrosive spacer having first and second ends disposed between said casket wall and said fastener assembly first portion load carrying surface, said spacer first end abutting said load carrying surface and said spacer second end abutting said casket wall outer surface, said spacer having a length dimension greater than the distance between said plate fastener securement and casket wall facing surfaces;

said noncorrosive spacer maintaining of said fastener assembly first portion in tension thereby maintaining said seal in compression between said fastener assembly second portion and said casket wall inner surface should said plate corrode and fall away from between said fastener assembly first portion load carrying surface and said casket wall.

* * * * *